United States Patent [19]

Simon et al.

[11] Patent Number: 5,043,695

[45] Date of Patent: Aug. 27, 1991

[54] HOUSING ASSEMBLY FOR MINIATURE ELECTRONIC DEVICE

[75] Inventors: Thomas E. Simon, Corona; Thanh V. Nguyen, Pomona, both of Calif.; Chin-Yuan Hsieh, Taipei, Taiwan

[73] Assignee: Bourns, Inc., Riverside, Calif.

[21] Appl. No.: 538,802

[22] Filed: Jun. 15, 1990

[51] Int. Cl.[5] ..... H01C 10/10; H01C 10/48

[52] U.S. Cl. ..... 338/199; 338/184; 338/193; 29/610.1

[58] Field of Search ..... 338/184, 162, 164, 199, 338/193, 237, 271, 272, 273, 276, 332, 333; 29/610.1, 619, 621

[56] References Cited

U.S. PATENT DOCUMENTS

| | | | |
|---|---|---|---|
| 3,601,743 | 8/1971 | Mathison et al. | 338/164 |
| 4,297,671 | 10/1981 | Flanders | 338/200 |
| 4,429,297 | 1/1984 | Nakatsu | 338/162 |
| 4,626,823 | 12/1986 | Smith | 338/199 |
| 4,675,989 | 6/1987 | Galloway et al. | 29/622 |
| 4,690,484 | 9/1987 | Oba et al. | 439/736 |
| 4,818,960 | 4/1989 | Satoh et al. | 333/185 |

*Primary Examiner*—Marvin M. Lateef

*Attorney, Agent, or Firm*—Howard J. Klein; William G. Becker

[57] ABSTRACT

A miniature electronic device includes a housing attached to a substrate by a plurality of terminal leads, each of which has a first end embedded or molded into the housing near the top surface thereof, and a second end bent around a side wall of the housing to engage the bottom surface of the substrate. The bottom surface of the substrate has a plurality of metallized areas, each of which is electrically connected to a component on the upper surface of the substrate. The second end of each lead is soldered or welded to a metallized area. The connection of the leads to the metallized areas secures the housing to the substrate, with the leads also providing the structure for the electrical and mechanical connection of the substrate (and the components thereon) to a circuit board.

17 Claims, 3 Drawing Sheets

HOUSING ASSEMBLY FOR MINIATURE ELECTRONIC DEVICE

BACKGROUND OF THE INVENTION

This invention relates generally to the field of miniature electronic components or devices, particularly surface-mounted devices. More specifically, the present invention relates to that class of such devices in which a component is carried on a substrate and enclosed within a housing that is attached to the substrate. An example of such a device would be a miniature, surface-mounted, trimming potentiometer.

In many miniature electronic devices, such as surface-mounted trimming potentiometers, an electronic component is mounted or formed (e.g., by thick film printing) on the surface of a ceramic substrate, along with its associated conductive paths and termination pads. Terminal leads, for mounting the device on a printed circuit board, are attached (as by soldering) to the termination pads, and the surface of the substrate carrying the component is enclosed within a housing.

It is frequently necessary to attach the housing to the substrate in such a way as to form an hermetic seal around the components on the substrate. Typically, this has been accomplished by using an epoxy cement to bond the housing to the substrate. A significant disadvantage to this attachment method is that the housing and the substrate must be mechanically held together while the cement cures. Moreover, different temperature coefficients of expansion among the cement, the plastic of the housing, and the ceramic of the substrate can result in a loss of seal integrity when the device is exposed to high temperatures.

The prior art has addressed these problems by employing purely mechanical means to attach the housing to the substrate, and to provide the necessary hermetic sealing. One such arrangement, using a combination of clips to hold the housing and substrate together, and an internal O-ring for hermetic sealing, is disclosed in U.S. Pat. No. 4,626,823 to Smith. In the Smith device, terminal leads having upwardly-extending extensions are soldered to the substrate. The extensions are directed generally perpendicularly to the substrate, and they terminate in inwardly-bent tabs which engage slots in the top of the housing. The tabs are crimped downwardly into the slots to lock the housing and the substrate together. This locking of the housing to the substrate compresses an O-ring inside the housing against the substrate, thereby providing an hermetic seal around the components on the substrate.

While clip-type mechanisms, such as that of the Smith patent, have been successfully used in certain applications, the increasing use of subminiature devices, i.e., those with horizontal dimensions in the range of 3–4 mm, makes further simplification of the mechanical structure of such devices highly advantageous. Moreover, there is a constant search in the electronic component industry to improve the product in such a way as to lower its manufacturing cost.

SUMMARY OF THE INVENTION

Broadly, the present invention is an electronic device, of the type having an electronic component carried on a substrate, a housing to enclose the component, and terminal leads attached to the substrate to provide electrical connection to a circuit board, wherein the leads are molded into the housing, with the free ends of the leads being bent over the sides of the housing and over the bottom surface of the substrate, to which the free ends are fastened.

More specifically, the present invention is a miniature, surface-mounted potentiometer or the like, in which the housing contains a rotor that carries a contact spring for making elecrical contact with a resistive element and a collector element on the upper surface of the substrate. The substrate has metallized termination pads on its bottom surface that are electrically connected to the resistive element and the collector element on its upper surface. One end of each of the leads is molded into the housing, and the free ends of the leads, after being bent around the housing sides and onto the bottom surface of the substrate, are soldered or welded to the termination pads. With this arrangement, the leads provide the means both for mechanically attaching and locking the housing to the substrate, and for electrically and mechanically connecting the substrate (and the electrical components on its upper surface) to a circuit board.

Another aspect of the present invention is the novel method of manufacturing the above-described device. A lead frame is provided with a repetitive pattern of stamped lead blanks appropriately arranged at each of a linear series of positions to provide the terminal leads of a potentiometer, for example, at each position. A housing is molded onto the lead blanks at each position, the housing oriented so that the lead blanks are embedded near the top surface of the housing. (To this end, the housing is advantageously molded upside-down, that is, with its open rotor cavity facing upwardly.) A rotor assembly is then installed in the housing cavity, and a substrate (with the electrical components thereon) is then placed over the cavity to close the housing. Next, the lead blanks are cut from the lead frame to form terminal leads of the appropriate length, and the free ends of the leads are bent over the sides of the housing and crimped onto the bottom surface of the substrate, where they are soldered or welded to the metallized termination pads that have been provided on that surface.

As will be more fully appreciated from the detailed description that follows, the present invention offers a number of advantages over the prior art. First, the housing and substrate are securely attached to one another, without the need for any cement, and without the relatively complex clip-type arrangements of the prior art. When combined with a sealing means between the rotor and the substrate (such as an O-ring or an alternative, as described below), good hermetic isolation of the electronic components on the substrate can be achieved. Second, by embedding the leads in the housing, the present invention exhibits increased structural strength as compared with clip-type mechanisms, such as that described in the aforementioned Smith patent. In addition, the leads serve a multiplicity of functions: (a) clamping the housing to the substrate; (b) providing the electrical and mechanical connection between the device and the circuit board, with the lead providing a relatively large solder fillet when attached to the board; and (c) providing a stand-off for the device to facilitate flux removal during the circuit board washing procedure. Furthermore, there is excellent physical and electrical isolation between the leads, with leaking around the leads into the functional portions of the device being substantially eliminated. Moreover, because the substrates are not insert-molded into the housing (as in many prior art devices), the probability of substrate cracking during assembly is minimized. Still another advantage is the relatively low cost and high yield of the manufacturing process, due, at least in part, to the ability to use the lead frame as a carrier for the housing as the other parts of the device are assembled with it.

DETAILED DESCRIPTION OF THE INVENTION

Figure 1:
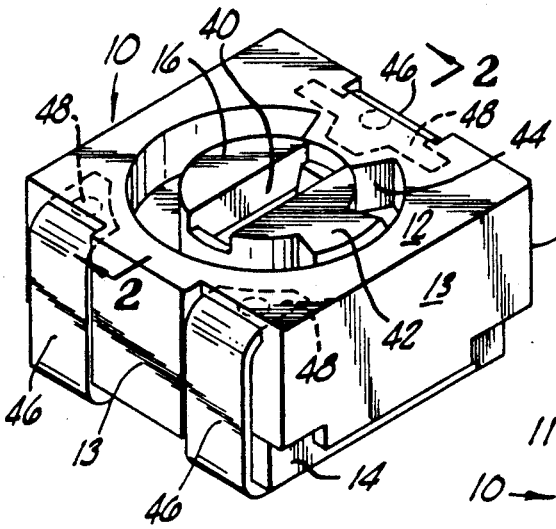
FIG. 1 is a perspective view of a miniature, surface-mounted, trimming potentiometer, constructed in accordance with a preferred embodiment of the present invention.

Referring first to FIGS. 1 through 4, there is illustrated a miniature, surface-mounted, trimming potentiometer 10, constructed in accordance with a preferred embodiment of the present invention. The potentiometer 10 includes a housing 11 having a top surface 12 and side walls 13 that enclose the top from a durable, high-temperature plastic, such as polyetheretherketane (PEEK), for example.

The housing 11 has a central cavity 15 that contains a rotor assembly, comprising a rotor 16, typically molded from nylon; an annular sealing insert 18 (to be described more fully below); and a wiper or contact spring 20, fixed into a central recess 22 on the underside of the rotor 16. The wiper 20 is typically a multi-wire wiper, a type well-known in the art, and may be stamped from a nickel-silver alloy. Other suitable alloys of precious or non-precious metals, depending on the application, may be used.

Figure 7:
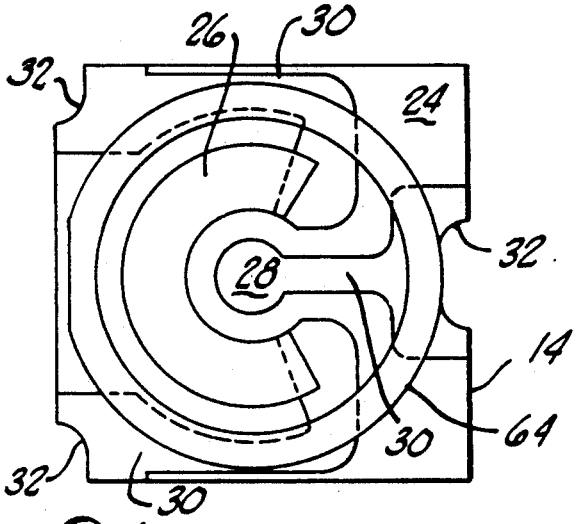
FIG. 7 is a top plan view of the substrate employed in the FIG. 6 embodiment, taken along line 7—7 of FIG. 6.

The substrate 14 is formed from a multi-up snapstrate (not shown), either laser-scribed or green-scribed for separation into individual substrates, as is well-known in the art. As shown best in FIG. 7, the substrate has an upper surface 24, on which a resistive element 26, a collector element 28, and metallized conductive traces 30 are formed. The resistive element 26 may be formed, for example, by vacuum printing or screen printing, using a thick film resistive ink. The collector 28 and the traces 30 are formed by vacuum printing with a suitable termination material. The side edges of the substrate 14 have channels or vias 32 (actually formed as through-holes in the multi-up snapstrate). The snapstrate is vacuum-printed with the termination material first on the upper surface, with the metallized material flowing more than half-way through the vias 32. Then, the bottom surface of the snapstrate is vacuum printed to form three termination pads 34 (FIG. 8) on the bottom surface 35 of the substrate, the termination material flowing the opposite way through the vias to join the termination material present therein from the printing of the upper surface 24, thereby forming a continuous conductive path from each of the traces 28 to an associated termination pad 34.

Figure 8:
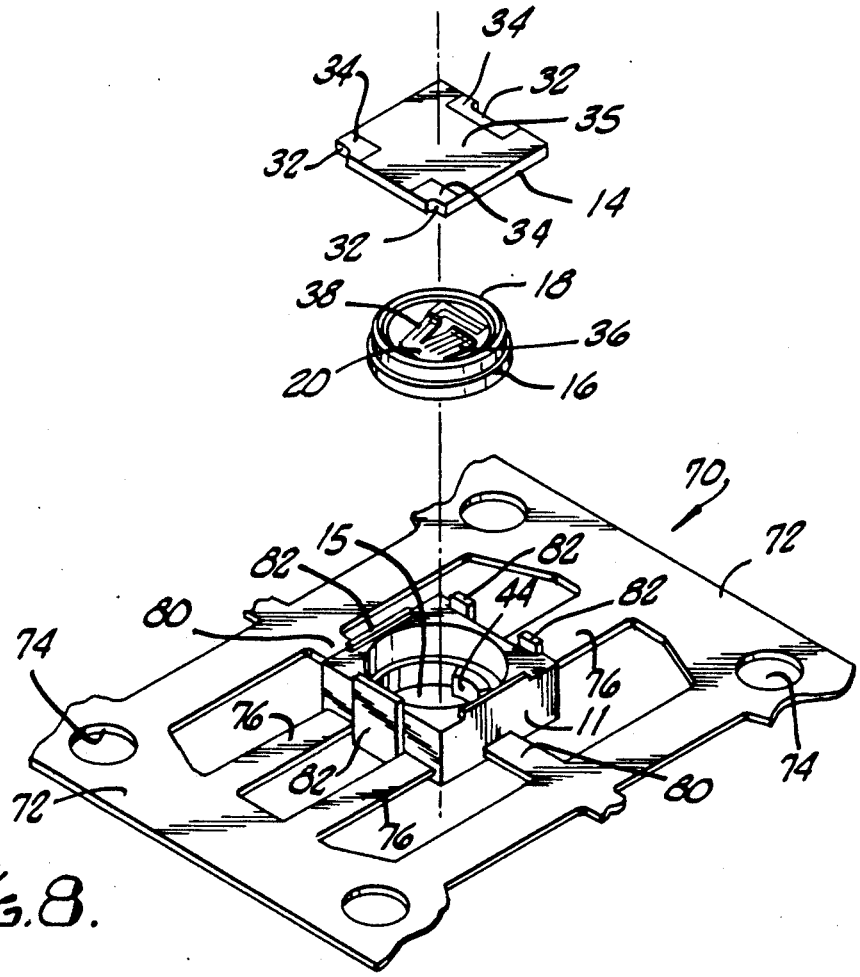
FIG. 8 is an exploded perspective view of a lead frame used in the manufacturing process of the present invention, showing the installation of the rotor and substrate assemblies into a housing that has been molded onto the lead frame.

As best shown in FIG. 8, the wiper 20 is configured with two sets of fingers: a larger set 36 for contacting the resistive element 26, and a smaller set 38 for contacting the collector 28.

The top surface of the rotor 16 is provided with a slot 40, adapted to receive a tool (not shown) for turning the rotor between its two limits of rotation. Also provided on the top of the rotor 16, as shown in FIG. 1, is a stop lug 42, formed as a radial projection, that abuts against a stop element 44, formed integrally with the housing, at either of the rotor's limits of rotation.

The illustrated embodiment has three terminal leads 46. Each of the leads 46 has a first, or captured end 48 that is embedded in the housing near the top surface of the latter. A second, or free end 50 of each lead 46 is then bent over the adjacent side of the housing and crimped onto the bottom surface 35 of the substrate 14, where it is attached to an associated termination pad 34 by a solder joint 52 or by welding. The sides of the housing are preferably provided with three vertical channels 54, each of which receives one of the bent-over terminal leads 46, thereby allowing the leads to be flush with the side walls of the housing, or slightly recessed therefrom, to save space.

With the captured ends 48 of the leads 46 embedded in the housing 11, and with the free ends 50 of the leads connected to the bottom surface 35 of the substrate 14, the housing 11 and the substrate 14 are securely attached to one another without the need for any cement. The leads thus provide the means for mechanically attaching the housing to the substrate, while also providing the means for electrically and mechanically connecting the electrical components on the substrate to a circuit board (not shown).

While the embodiment described herein has three leads, the present invention can be employed in a device having as few as two leads, or more than three, provided that at least two opposing sides of the housing are secured to the substrate by means of the leads.

Figure 2:
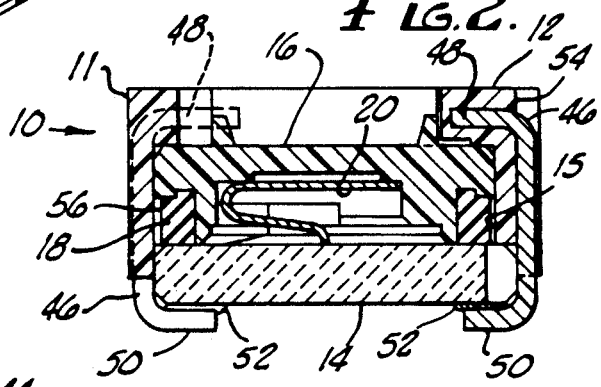
FIG. 2 is a cross-sectional view taken along line 2—2 of FIG. 1.
Figure 4:
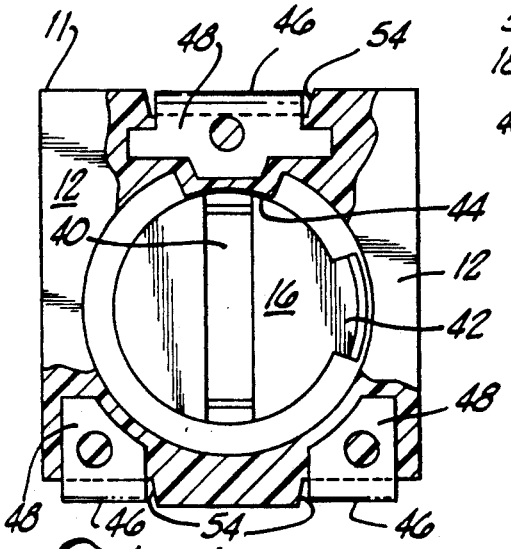
FIG. 4 is a top plan view, partially broken away, of the potentiometer of FIG. 1.
Figure 3:
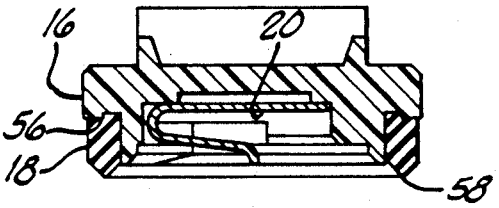
FIG. 3 is a cross-sectional view of the rotor assembly shown in FIG. 2, showing the sealing ring in its uncompressed state.

As previously mentioned, the rotor 16 is provided with peripheral sealing means to provide an hermetic seal between the substrate and the rotor. In the preferred embodiment of the invention (FIGS. 2 and 3), this sealing means takes the form of an annular rotor insert 18. The insert 18 is formed of a suitable resilient material, preferably silicone rubber, and it is co-molded with the rotor so as to be seated in an annular peripheral channel 56 formed in the bottom surface of the rotor. The insert 18 preferably has an axially-extending sealing edge 58 formed by a pair of surfaces joined at an apex of an angle of approximately 90 degrees, as shown in FIG. 3. When the rotor is installed in the housing and the substrate is attached to the housing, as described above, the resilient insert 18 is compressed, as shown in FIG. 2, deforming the sealing edge 58 as it is pressed against the substrate to provide an effective hermetic seal.

Figure 5:
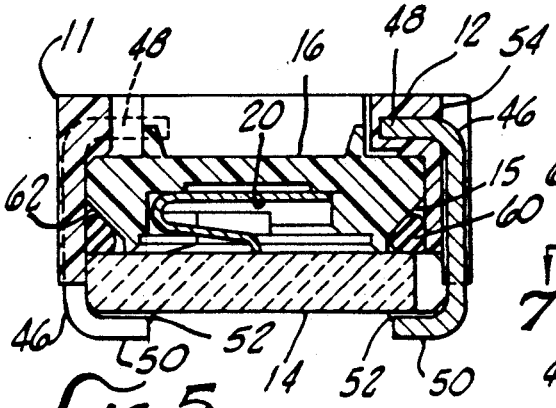
FIG. 5 is cross-sectional view, similar to that of FIG. 2, showing a first alternative embodiment of the rotor sealing means.

In a first alternative embodiment, shown in FIG. 5, the sealing means is a conventional silicone rubber O-ring 60. In this embodiment, the lower face of the rotor 16 is formed with a sealing surface 62 around its periphery. The sealing surface 62 slopes upwardly, in the radially-outward direction, at an angle of approximately 45 degrees. The O-ring 60 is compressed between the sealing surface 62 and the substrate 14 to effect the hermetic seal, when the substrate and the housing are clamped together, as described by the leads 46.

Figure 6:
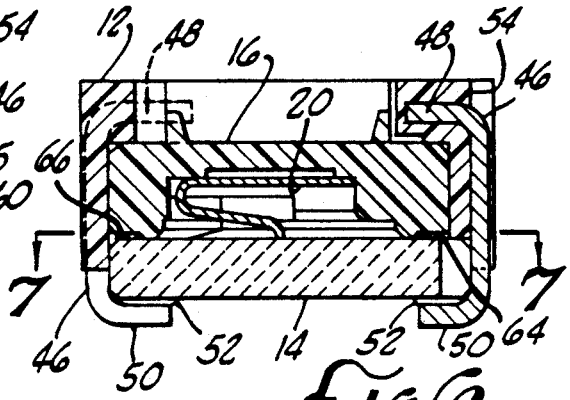
FIG. 6 is a cross-sectional view, similar to that of FIG. 2, showing a second alternative embodiment of the rotor sealing means.

In a second alternative embodiment, shown in FIGS. 5 and 6, the sealing means takes the form of a resilient silicone ring 64 printed onto the upper surface of the substrate 14. The lower face of the rotor 16 is provided with an annular peripheral track 66 that registers with the printed silicone ring 64 and sealingly engages against it to provide the hermetic seal between the rotor and the substrate, when the housing and substrate are attached in the manner described above.

Figure 9:
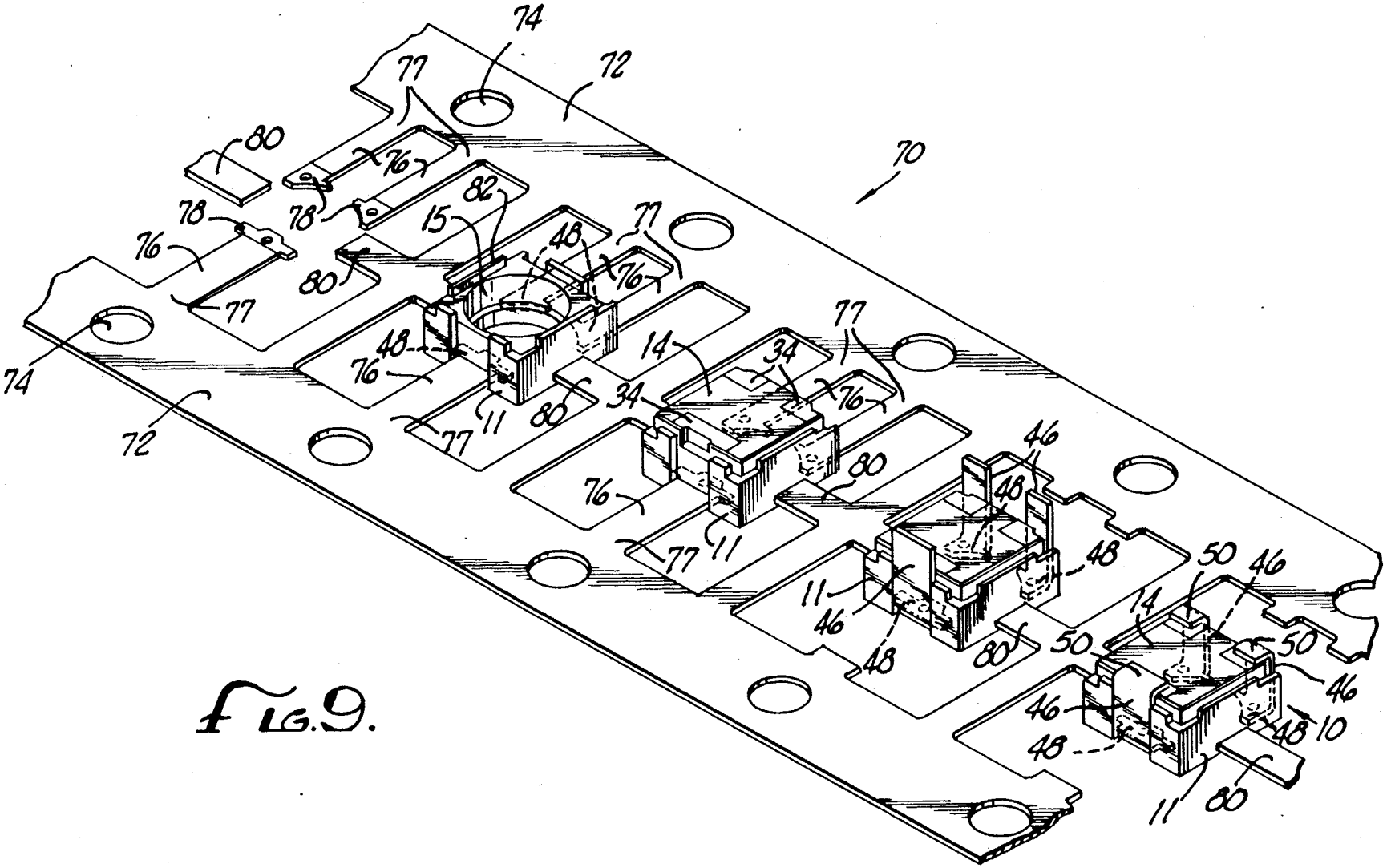
FIG. 9 is a perspective view of the lead frame used in the manufacturing process of the present invention, showing several of the steps in the process.

FIGS. 8 and 9 illustrate the method of fabricating the device described above. Referring first to FIG. 9, there is provided a lead frame 70, comprising a pair of parallel side rails 72, with evenly-spaced locator holes 74. The lead frame 70 further comprises a linear array or series of assembly locations, each, in turn comprising three laterally-oriented lead blanks 76, each with an exterior end 77 connected to a side rail and interior end 78, arranged as appropriate for the device to be fabricated; and two tie bars 80, oriented parallel to the rails 72. These elements are most clearly shown at the 4 leftmost assembly location shown in FIG. 9.

The next assembly location to the right in FIG. 9 shows a housing 11 that has been molded onto the lead frame. The molding step is performed so that the interior ends 78 of the lead blanks 76 are molded into the housing, thereby becoming the captured ends 48 of the terminal leads 46, as described above. The molded housing is formed upside-down, thereby orienting the open central cavity 15 upwardly. The housing is engaged on opposite sides by the tie bars 80.

Referring now to FIG. 8, the rotor assembly (the rotor 16, the annular sealing insert 18, and the wiper 20) are now installed in the cavity 15. The cavity is then closed by placing the substrate onto the housing with the metallized pads 34 on the exterior. Proper placement of the substrate is facilitated by locator lugs 82 (FIG. 8), formed integrally with the housing, and protruding from its bottom surface. The closed housing-/rotor/substrate assembly is shown at the center assembly location in FIG. 9.

Referring once again to FIG. 9, proceeding to the next assembly location to the right on the lead frame, the next step in the fabrication process is to cut the lead blanks 76 to their appropriate lengths from the lead frame 70, and then bend them up over the side walls of the housing. At this point, the lead blanks have been formed into the terminal leads 46, each having a free end 50, as discussed above, at the point of separation from the side rail. As shown at the rightmost assembly position in FIG. 9, the next step is to crimp the separation from the side-rail. As shown at the rightmost assembly position in FIG. 9, the next step is to crimp the free ends 50 over onto the bottom surface 35 of the substrate, so as firmly to engage the termination pads 34 thereon. The free ends 50 are then electrically and mechanically connected to the pads by soldering (reflowing a solder paste or solder dipping) or by welding. The result is a finished potentiometer 10.

If testing of the finished potentiometer 10 is desired, such testing can be performed while the device is still held in the lead frame by the tie bars 80. When assembly and testing have been completed, the finished potentiometer 10 is removed from the lead frame by breaking it away from the tie bars.

Although the invention has been described in the context of a surface-mounted miniature trimming potentiometer, it would be well within the ordinary level of skill in the pertinent arts to adapt the present invention to a wide variety of electronic devices. Likewise, the leads can easily be modified (by adding an outwardly extending foot, for example) for a socket-mounted device. These and other modifications that may suggest themselves should be considered within the spirit and scope of the invention.

What is claimed is:

1. An electronic device, including an electronic component carried on the upper surface of a substrate having an upper surface and a bottom surface, a housing having a top surface and side walls enclosing the upper surface of the substrate, and leads attached to the substrate on at least two opposed sides thereof, the improvement wherein each of the leads has a first end molded into the housing near the top surface thereof, and a second end attached to to the bottom surface of the substrate, whereby the leads attach the housing to the substrate, while also providing means for electrically and mechanically connecting the susbtrate to a circuit board.

2. The device of claim 1, wherein the second end of each of the leads is electrically and mechanically connected to a metallized area on the bottom surface of the substrate.

3. The device of claim 2, wherein each of the metallized areas is electrically connected to a component on the upper surface of the substrate.

4. The device of claim 1, further comprising:

a rotary element contained within the housing; and resilient sealing means engaged between the rotary element and the upper surface of &:he substrate, for providing a substantially- hermetic seal between the rotary element and the substrate as a result of the attachment of the housing to the substrate by means of the leads.

5. The device of claim 4, wherein the resilient sealing means comprises:

an annular peripheral channel in the rotary element; and a resilient annular insert fixed in the channel, the insert having an axially-extending sealing edge that is compressible against the substrate as a result of the attachment of the housing to the substrate by the leads.

6. The device of claim 5, wherein the axially-extending edge is formed by a pair of surfaces joined at an angle of approximately 90 degrees.

7. The device of claim 4, wherein the sealing means includes an O-ring disposed between the rotary element and the substrate.

8. The device of claim 4, wherein the sealing means comprises:

a resilient ring formed on the upper surface of the substrate; and an annular track positioned on the rotary element so as to register with and sealingly engage the resilient ring when the housing is attached to the substrate by the leads.

9. An electronic device, comprising:

a substrate having an upper surface and a bottom surface, and carrying an electronic component on the upper surface thereof;

a housing having a top surface and side walls enclosing the upper surface of the substrate;

a terminal lead attaching at least two opposing side walls of the housing to the substrate, each of the terminal leads having a first end molded into the housing near the top surface thereof, and a second end attached to a metallized area on the bottom surface of the substrate, whereby the leads attach the housing to the substrate while providing means for electrically and mechanically connecting the substrate to a circuit board;

a rotary element contained within the housing; and sealing means engaged between the rotary element and the upper surface of the substrate for forming a substantially hermetic seal between the rotary element and the substrate when the housing is attached to the substrate.

10. The device of claim 9, wherein the metallized areas are electrically connected to the component on the substrate.

11. The device of claim 9, wherein the side walls of the housing are provided with vertical channels, each of the channels receiving a portion of one of the leads between the first and second ends thereof.

12. The device of claim 9, wherein the sealing means comprises:

an annular peripheral channel in the rotary element; and a resilient annular insert fixed in the channel, the insert having an axially-extending sealing edge that is compressible against the substrate as a result of the attachment of the housing to the substrate by the leads.

13. The device of claim 12, wherein the sealing edge is formed by a pair of annular surfaces joined at an angle of approximately 90 degrees.

14. The device of claim 9, wherein the sealing means includes a resilient O-ring disposed between the rotary element and the substrate.

15. The device of claim 9, wherein the sealing means comprises:

a resilient ring formed on the upper surface of the substrate; and an annular track positioned on the rotary element so as to register with and sealingly engage the resilient ring when the housing is attached to the substrate by the leads.

16. A method of manufacturing an electronic device, comprising the steps of:

(a) providing a lead frame having a pair of parallel side rails defining an assembly location therebetween, the assembly location comprising a plurality of laterally-oriented lead blanks connected to the side rails, each of the lead blanks having an interior end;

(b) molding a housing onto the lead blanks so that the interior ends of the lead blanks are molded into the housing, the molded housing being shaped and oriented so as to have an upwardly-directed cavity;

(c) providing a substrate having a first surface with an electronic component formed thereon and an opposite surface having metallized areas formed thereon so as to be electrically connected to the component;

(d) closing the cavity by placing the substrate onto the housing with the surface having the metallized areas being exterior to the housing;

(e) cutting the lead blanks from the side rails so as to form laterally-directed leads of a selected length, each of the leads having a free end at the point of separation from the side rail;

(f) bending the leads so that the free ends thereof each engage one of the metallized areas; and (g) forming an electrical and mechanical connection between each of the leads and its associated metallized area.

17. The method of claim 16, wherein the lead frame comprises a linear series of assembly locations, and wherein, at each location, the steps of molding the housing, providing the substrate, closing the cavity, cutting the lead blanks, bending the leads, and forming the electrical and mechanical connections are performed.

* * * * *

UNITED STATES PATENT AND TRADEMARK OFFICE

CERTIFICATE OF CORRECTION

PATENT NO. : 5,043,695

DATED : August 27, 1991

INVENTOR(S) : Thomas E. Simon et al.

It is certified that error appears in the above-identified patent and that said Letters Patent is hereby corrected as shown below:

Column 3, Line 46: "...that enclose the top from a durable, high-temperature plastic, such as polyetheretherketane (PEEK), for example." should read --...that enclose the top surface of a ceramic substrate 14. The housing 11 is molded from a durable, high-temperature plastic, such as polyetheretherketane (PEEK), for example. --

Column 5, Line 32: "shown at the 4 leftmost" should read -- shown at the leftmost --.

Column 6, Line 43: "surface of &:he substrate" should read -- surface of the substrate --.

Signed and Sealed this

Twenty-third Day of February, 1993

*Attest:*

STEPHEN G. KUNIN

*Attesting Officer*

*Acting Commissioner of Patents and Trademarks*